US005236392A

United States Patent [19]

Fauciglietti

[11] Patent Number: 5,236,392

[45] Date of Patent: Aug. 17, 1993

[54] ASSEMBLABLE FRAME FOR DOORS, SLIDING DOORS AND SIMILAR OF VENEERED TYPE WITH PREFABRICATED COMPONENTS AND RELEVANT METHOD

[75] Inventor: Renzo Fauciglietti, Cantu, Italy

[73] Assignee: Fauciglietti Engineering S.R.L., Cantu, Italy

[21] Appl. No.: 846,789

[22] Filed: Mar. 4, 1992

[30] Foreign Application Priority Data

Mar. 13, 1991 [IT] Italy ..... MI91 A 000672

[51] Int. Cl.[5] ..... E06B 3/70

[52] U.S. Cl. ..... 52/455; 52/456

[58] Field of Search ..... 52/455, 457, 456, 807, 52/821, 829, 830, 204, 205; 49/501, 462

[56] References Cited

U.S. PATENT DOCUMENTS 2,706,543 4/1955 Kamerer ..... 52/455 X 3,479,770 11/1969 Mock ..... 49/50

*Primary Examiner*—Carl D. Friedman

*Assistant Examiner*—Creighton Smith

*Attorney, Agent, or Firm*—Herbert Dubno

[57] ABSTRACT

A frame for a door or the like has a multiplicity of cross members formed with outer surfaces as supports for finishing panels and having their ends matingly engaged with joints formed by longitudinal sections forming the opposite longitudinal edges of the door and having seats engaging the panels.

10 Claims, 3 Drawing Sheets

ASSEMBLABLE FRAME FOR DOORS, SLIDING DOORS AND SIMILAR OF VENEERED TYPE WITH PREFABRICATED COMPONENTS AND RELEVANT METHOD

FIELD OF THE INVENTION

The present invention relates to an assemblable frame for producing panels, doors and the like of the so-called veneered type.

It is known that in joinery practice it is possible to make panels, sliding doors, doors and the like of the so-called veneered type, that is, consisting of a series of cross members produced in various configurations, dimensions and materials, the ends of which terminate in an edge frame that stiffens the frame thus formed, to which there are then glued flat covering layers such as sheets of plywood, veneers and the like.

This technique makes it possible to obtain panels of very low weight with a high degree of finish and stability over in the course of time. However, because of the difficulty of implementing such technique, which calls for highly skilled personnel, precision work and careful selection of the materials to be joined, resulting in high costs, the technique has in practice become obsolete.

OBJECT OF THE INVENTION

It is the object of the invention to provide an improved door frame capable of being assembled in an easy and reproducible manner, even by unskilled personnel, to which it, is possible to apply in a likewise easy, quick and reproducible manner finishing layers for the purpose of forming doors, panels, sliding doors or the like of the so-called veneered type.

The frame according to the invention should moreover be made of inexpensive materials readily available on the market and easy to shape according to the desired features and dimensions, even outside normal standards.

SUMMARY OF THE INVENTION

This object is attained according to this invention by a frame for doors, sliding doors and the like of veneered type which consists of a multiplicity of cross members, suitably formed and capable of constituting, by means of their outer surface, supports for finishing panels, the free ends of which have joining devices capable of engaging with the matching joining devices of sections extending lengthwise over the full height of the door or the like and provided with shaped seats capable of overlapping the free edges of such panels in order to cooperate in the retention thereof and impart protection thereto.

More particularly, the frame for a door according to the invention has its cross-members constructed with an internal lattice structure stiffened transversel by a flat member and the cross-members have a plan of substantially elliptical form relative to the longitudinal axis in order to make possible the production of doors with convex surfaces, or a plan of substantially rectangular symmetrical form relative to the longitudinal axis for the production of doors and the like with flat surfaces.

According to a further feature of the invention is the fact that such longitudinal sections are of symmetrical form relative to a transverse axis and are provided with seats for the reversible fitting of hinges arranged in such a way as to allow the operation of the door with right-hand or left-hand hingeing and inward or outward opening.

The invention also relates to a method of producing a door or the like by means of a frame according to the foregoing description which comprises the following phases:

a) preparation of cross members of suitable form in plan and with lateral edges ready for gluing;
b) presetting in a horizontal plane of a first flat-surface panel;
c) supporting, at preset intervals, a plurality of such cross members with their lower edges on the flat surface of such first panel;
d) supporting of a second flat-surface panel on the upper surface of such cross members;
e) bending of both panels to a preferred shape, for example with a flat, convex or concave surface;
f) gluing of the panels to such cross-members with possible curvature of the surfaces;
g) application of the longitudinal sections to the flanks of the door thus obtained; and
h) finishing of the external surface of the panels.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
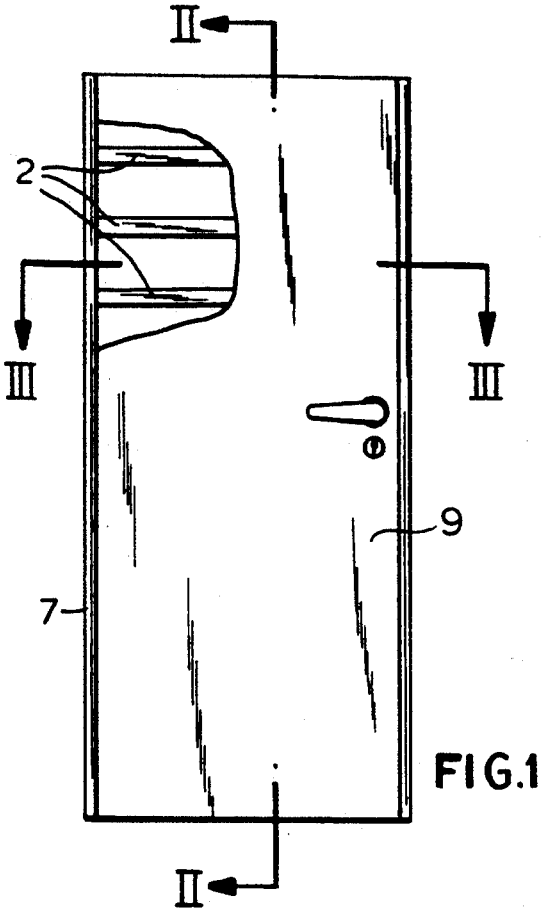
FIG. 1 is a cutaway view of a door made with a frame according to this invention.
Figure 2:
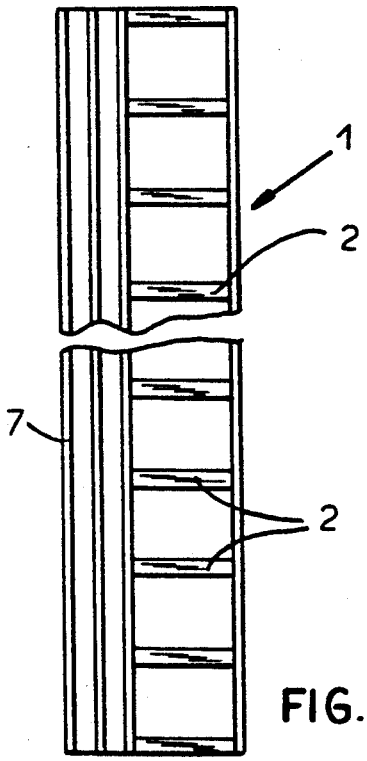
FIG. 2 is a cross-section taken along line II—II of FIG. 1.
Figure 3:
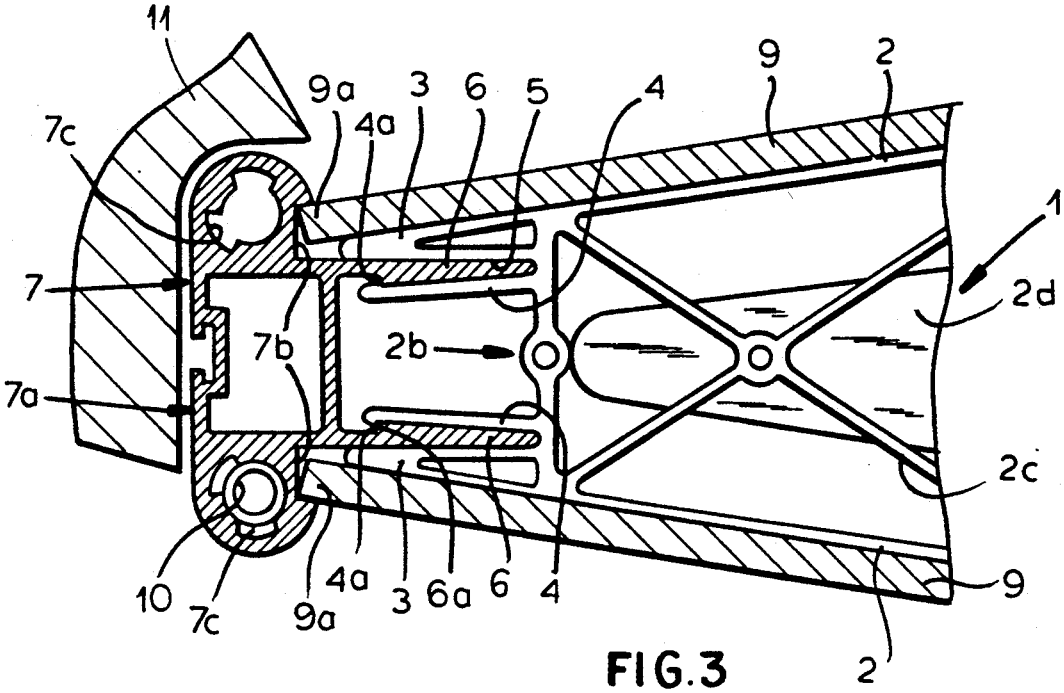
FIG. 3 is a cutaway view taken along line III—III of FIG. 1.

As shown in the drawing, the door according to this invention is comprised of a frame 1 consisting of a series of cross members 2 located parallel to one another at a preset distance in a vertical sense. The opposite ends 2*a*, 2*b*, of the cross members are symmetrically formed with two shaped projections 3 parallel to which and in an inner position relative thereto extend two flexible tongues 4, provided with inwardly projecting teeth 4*a* which form, with such projections 3, two pairs of grooves 5 capable of accommodating and retaining, following bending and subsequent resetting of such flexible tongues, two matching projecting tabs 6, provided with matching teeth 6*a*, of a lateral section 7 which extends lengthwise over the full height of the door and is therefore capable of retaining all the cross-members 2 forming a lateral sealing edge.

In a preferred form of implementation cross members 2 are each comprised of a section made of plastic material internally stiffened by a lattice 2*c* and by a solid crosspiece 2*d*.

The lateral sections 7 each have additionally a head 7*a* in which are located two pairs of seats 7*b* and 7*c*, the purpose of which will become more clearly apparent from the following.

Figure 4A:
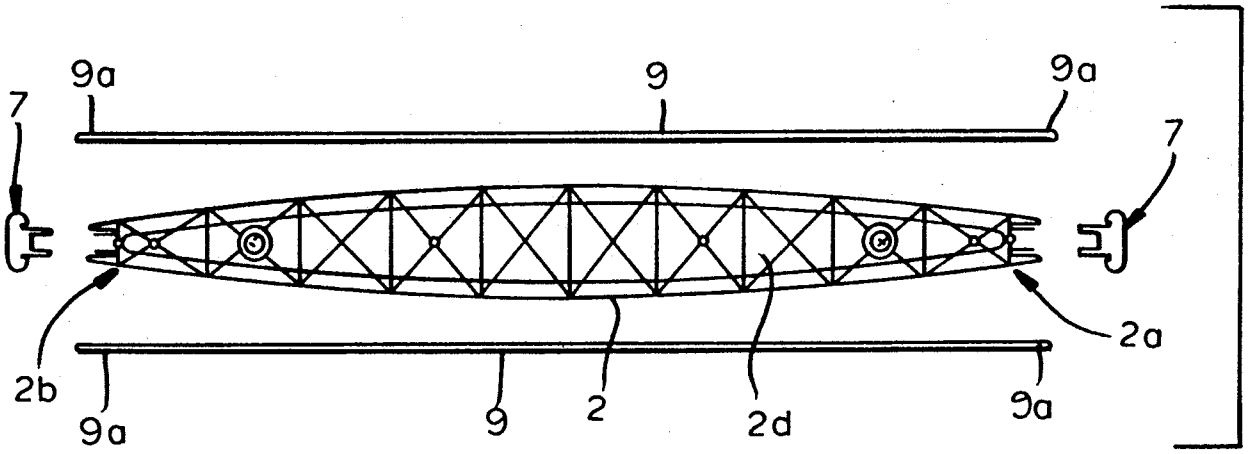
FIG. 4*a* is is an end view of the door at the assembly stage shown in exploded view.
Figure 4B:
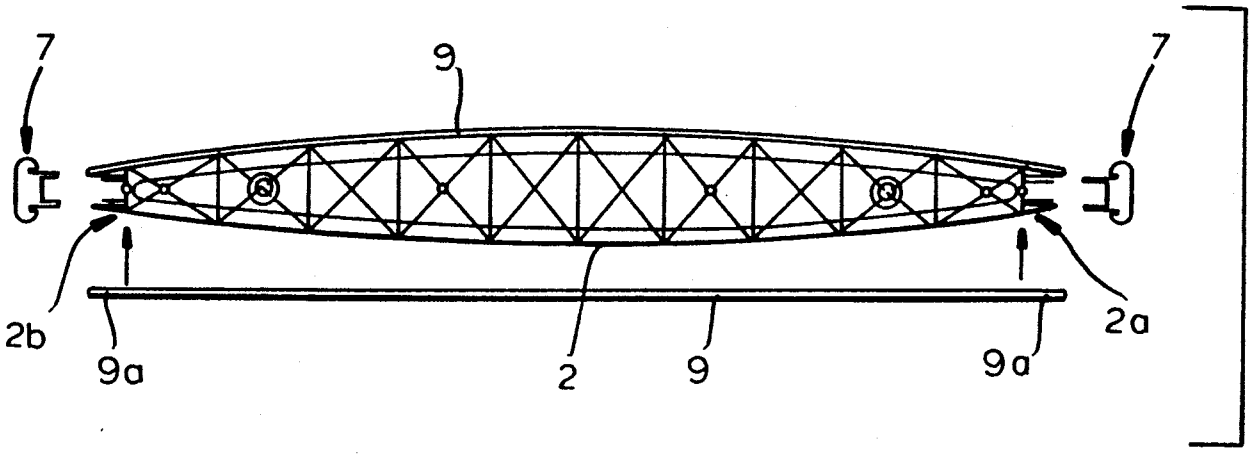
FIG. 4*b* is is a view similar to FIG. 4*a* of the partly assembled door.

As illustrated in FIGS. 4*a* and 4*b*, once a series of cross-members 2 is lined up, there are applied thereto finishing panels 9, initially flat and then curved in order to adhere to members 2 to which they are subsequently glued; longitudinal sections 7 are fitted by pressing tabs 6 into grooves 5 where they are locked by means of the said flexible resetting of tongues 4 and the reciprocal engagement of teeth 4*a* and 6*a*.

Figure 5A:
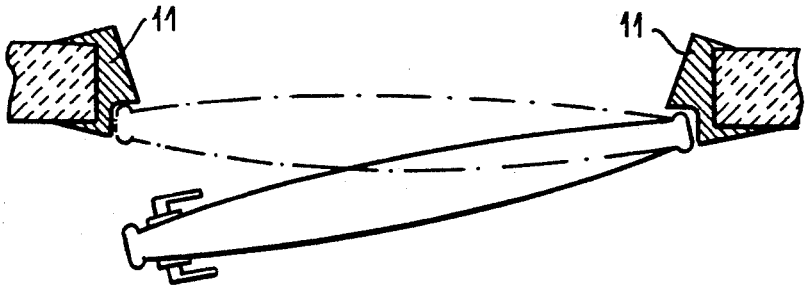
FIGS. 5*a* and 5*b* are sectioned views showing two examples of an outward-opening door with right-hand or left-hand hingeing.
Figure 5B:
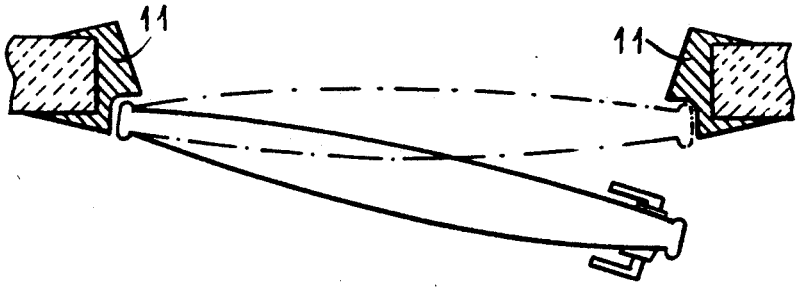

During such joining procedure the free lateral edges 9*a* of panels 9 become inserted in seats 7*b* which cooperate in retaining such panels while at the same time imparting protection to the panels themselves. In seats 7*c* it is possible to insert hinge units 10 which, by cooperating with non-illustrated matching members applied to frame 11 (FIGS. 5*a* and 5*b*) of the door, allow the rotation thereof for opening and closing; additionally, as a result of the special symmetrical configuration of longitudinal section 7, such hinges may be applied in such a way as to achieve reversibility of the door, which may be arranged for opening outward to the right (FIG. 5*a*) or to the left (FIG. 5*b*) or symmetrically inverted for opening inward, not illustrated.

As can be noted from the figures, a frame according to the invention makes it possible to achieve with simple and rapid assembly operations doors and the like of any cross section; by prearranging the form of the cross-members which, in the example described, have both their outer supporting surfaces of convex shape, this representing one of the cases of greatest production difficulty for veneered panels.

The method for producing a door or similar by means of a frame according to the foregoing description substantially comprises the following phases:

a) preparation of cross-members of suitable form in plan and with lateral edges ready for gluing;
b) presetting in a horizontal plane of a first flat-surface panel;
c) supporting, at preset intervals, a plurality of such cross members with their lower edges on the flat surface of such first panel;
d) supporting of a second flat-surface panel on the upper surfaces of the cross-member;
e) bending of both panels to a shape, defined by the surfaces of the cross members, for example a a preferred shape, for example with a flat, convex or concave shape;
f) gluing the panels to such cross members with possible curvature of the surfaces;
g) application of the longitudinal sections to the flanks of the door thus obtained; and
h) finishing of the external surface of the panels.

Similarly such cross-members may be flat and of any desired size. Obviously many variants may be introduced into the constructional details of the various members without thereby departing from the scope of this invention. In particular; in particular there may be varied according to any both the internal structure of the individual cross-members and the types of attachment to the longitudinal section may be varied.

I claim:

1. A door comprising:

a multiplicity of cross members each of the cross members being formed with:

respective opposite outer surfaces, a respective internal lattice structure having free ends in said cross member, and a respective flat member extending between the opposite free ends and transversely stiffening the lattice structure; a pair of finishing panels flanking the outer surfaces of the cross members and having free longitudinal edges; and a pair of longitudinal sections extending lengthwise over a full height of the door, each of the sections being provided with:

shaped seats overlapping respective free edges of the panels in order to cooperate in the retention of the panels and impart protection to the panels, and joining means for engaging a free end of the cross member, each of the free ends of the pair of opposite ends of the cross member being provided with a engaging means for engaging the joining means of a one of the sections.

2. A frame for a door according to claim 1 wherein said cross members have an internal lattice structure stiffened transversally by a flat member.

3. A door comprising:

a multiplicity of cross members having free ends, each of the cross members having in a plan view a substantially elliptical shape with respect to a longitudinal dimension of the door and being formed with:

opposite outer surfaces spaced from one another, and pair of opposite free ends bridging the surfaces;

a pair of longitudinal finishing panels flanking the outer surfaces of the cross members and having free longitudinal edges, the finishing panels having outwardly convex surfaces upon mounting the finishing panels on the outer surfaces of the cross members; and a pair of longitudinal sections extending lengthwise over a full height of the door and provided with shaped seats receiving the free edges of the panels and with a joining means for engaging a free end of the cross member, each of the free ends of the pair of opposite ends of the cross member being provided with a engaging means for cooperating with the joining means of a one of the sections.

4. The door according to claim 1, wherein said engaging means of cross members includes grooves delimited by a rigid member and by a tongue flexibly deformable transversely and provided with a tooth engaging an inner surface inferentially claimed of one of said sections.

5. The door according to claim 1, wherein said joining means of sections includes two tabs provided with meshing teeth capable of engaging with teeth of tongues of said cross members, thus locking said sections in position.

6. The door according to claim 1, wherein said cross members have a plan of substantially rectangular symmetrical form relative to a longitudinal axis.

7. The door according to claim 1, wherein said sections are of symmetrical form relative to a transverse axis and are provided with seats for reversible fitting of hinges arranges in such a way as to allow the operation of the door selectively with right-hand or left-hand hinging and inward and outward opening.

8. A door comprising:

a plurality of mutually parallel transversely spaced cross members formed at opposite ends thereof each with a pair of outwardly open grooves and a respective tooth at a mouth of each of said grooves;

a pair of longitudinal sections extending along opposite longitudinal edges of the door and each formed with a pair of tabs received in the grooves at one end of each of said cross members, each of said tabs having a tooth engaged by a tooth at the mouth of a corresponding groove of each of said cross members, each of said sections being further provided with a respective pair of seats extending longitudinally over the length of the respective section flanking the respective tabs; and a pair of panels flanking said cross member and having free edges engaged in said seats, each of said cross members comprising a lattice structure between the ends thereof.

9. The door defined in claim 8 wherein said cross members have an outwardly convex curvature, said panels being curved to conform to the curvature of said cross members.

10. The door defined in claim 9 wherein each of said cross members is further provided with an internal solid cross piece for stiffening same.

* * * * *